US006016678A

United States Patent [19]

Diller

[11] Patent Number: 6,016,678

[45] Date of Patent: Jan. 25, 2000

[54] TUBE EXPANDING AND FLANGE-FORMING TOOL

[75] Inventor: Charles E. Diller, Springfield, Ohio

[73] Assignee: Cooper Technologies Company, Houston, Tex.

[21] Appl. No.: 09/146,045

[22] Filed: Sep. 2, 1998

Related U.S. Application Data

[60] Provisional application No. 60/058,059, Sep. 5, 1997.

[51] Int. Cl.[7] ..... B21D 3/02

[52] U.S. Cl. ..... 72/119; 72/123; 29/523

[58] Field of Search ..... 72/118, 119, 120, 72/122, 123, 370.03, 370.06, 370.08, 393; 29/523, 727

[56] References Cited

U.S. PATENT DOCUMENTS

| | | | |
|---|---|---|---|
| 1,815,174 | 7/1931 | Weideke | 72/118 |
| 1,944,338 | 1/1934 | Wiedeke | 72/123 |
| 2,526,025 | 10/1950 | Hoeppe | 72/123 |
| 3,221,528 | 12/1965 | Linthicum et al. | 72/122 |
| 3,228,224 | 1/1966 | Anderson | 72/123 |
| 3,353,386 | 11/1967 | Fisher | 72/123 |
| 3,773,117 | 11/1973 | Dussel | 173/4 |
| 3,947,950 | 4/1976 | Adams | 29/523 |
| 4,090,382 | 5/1978 | Schott | 72/119 |
| 4,099,400 | 7/1978 | Schott | 72/122 |
| 4,109,513 | 8/1978 | Schott | 73/49.1 |
| 4,186,584 | 2/1980 | Schott | 72/122 |
| 4,327,567 | 5/1982 | Martin | 72/123 |
| 4,424,629 | 1/1984 | Schott | 30/105 |
| 4,868,193 | 9/1989 | Lee | 514/314 |
| 5,129,246 | 7/1992 | Strickland et al. | 72/21 |

OTHER PUBLICATIONS

Thomas C. Wilson, Inc., "Wilson Combination Beading Expander", *Operating Insructions, Care & Maintenance, Replacement Parts.*

*Primary Examiner*—Ed Tolan
*Attorney, Agent, or Firm*—Coats & Bennett, P.L.L.C.

[57] ABSTRACT

A tool for expanding a tube into engagement with a wall of a hole in a plate and simultaneously forming a flange on the end of the tube has a mandrel having a tapered distal portion. The mandrel receives for rotation and axial displacement a tubular cage. The cage carries expanding rolls, each of which is supported for rotation in a slot in a distal portion of the cage, is displaceable radially, is in rolling engagement with the tapered portion of the mandrel and the tube when the tool is in operation, and is skewed at a small angle to the mandrel axis so as to impart traction to the cage and the mandrel and draw them distally into the cage upon rotation of the mandrel. A forming roll is supported for rotation and for displacement radially with respect to the mandrel axis in an opening in the cage and has: at least one conical following surface that is in rolling engagement with the tapered portion of the mandrel; a conical expanding surface that is in rolling engagement with the tube; a forming surface immediately adjacent the expanding surface proximally that is in rolling engagement with the tube; and a conical thrust-receiving surface at a proximal end. Axial force is transmitted from the cage to the thrust-receiving surface by an annular two race axial thrust bearing, which is supported on and surrounds the cage proximally of the forming roll.

46 Claims, 4 Drawing Sheets

TUBE EXPANDING AND FLANGE-FORMING TOOL

CROSS REFERENCE TO RELATED APPLICATIONS

This application claims the benefit of U.S. Provisional Application Ser. No. 60/058,059, filed Sep. 5, 1997, pursuant to 35 U.S.C. §119(e).

TECHNICAL FIELD OF THE INVENTION

The invention relates to equipment and methods for installation of tubes into tubesheets primarily for firetube boilers.

BACKGROUND OF THE INVENTION

The tubes of firetube boilers are received in holes in tube sheets and are affixed and sealed to the tube sheets by expanding the end portions of the tubes into engagement with the walls of the holes and forming beads on the ends of the tubes. Prior to performing the expanding and forming operations, the tubes are cut to length, leaving a portion of each tube extending a specified distance beyond the surface of the tube sheet. The extending portions of the tubes are formed into generally arcuate, radially outwardly extending beads having convex surfaces facing away from the tube sheet. The beads enhance the mechanical attachment between the tubes and the tube sheet and protect the ends of the tubes from flame erosion.

Tools for performing the expanding and beading operations are available. Often, one tool is used for expanding the tubes, and a reciprocating hammer is used to form the beads. Hammering tools require considerable skill to make proper beads and make a lot of noise. Forming by hammering, moreover, usually destroys the integrity of the tube-to-hole wall joints and requires expanding the tubes again after hammering.

A tool that both expands and beads the tubes of firetube boilers in a single operation is described and shown in U.S. Pat. No. 4,090,382 (Schott, 1978) and is commercially available. A mandrel having a tapered distal end receives a cage that is rotatable and movable axially relative to the mandrel and supports several expanding rolls for rotation, the rolls being engaged by the mandrel and being skewed relative to the axis of the mandrel at a very small angle. When the mandrel is driven in rotation and with the expanding rolls in engagement with the tube, the expanding rolls exert a traction force on the mandrel that pulls it distally relative to the cage, thus forcing the expanding rolls radially outward and gradually expanding the tube. The drafting action resulting from the skew of the expanding rolls also draws the cage into the tube, but only to an extent permitted by the beading roll or rolls, as described in the next paragraph.

In one embodiment disclosed in the Schott patent and in the commercially available tool, a beading roll is mounted on the cage for rotation about an axis that is radial with respect to the axis of the mandrel. The beading roll is in rolling and supporting engagement with two thrust rolls, which transmit an axial force from the cage to the beading roll (or rolls) as the cage is pulled into the tube by the distal traction of the expanding rolls. The axial force applied to the beading roll forms an arcuate bead on the end of the tube by deforming the tube end to match the shape of the forming surface of the beading roll. The formed bead acts as a stop for the cage, which stops moving into the tube when the bead is fully formed. The position of the beading roll radially of the cage and the tube is fixed—the beading roll tracks a fixed rotary path around the end of the tube. Meanwhile, the expanding rolls are translating radially outwardly relative to the axis of the tube as expanding progresses. Also, the track of the beading roll along the tube does not overlap the tracks of the expanding rolls along the tube. Accordingly, the tool of the Schott patent tends to leave a ridge projecting into the tube at the juncture between the bead and the expanded part of the tube.

The tubes of firetube boilers are of standard diameters (2", 2.5" and 3"), but each size comes in different gages. In order to match the bead to the gage of the tube, the tool of the Schott patent requires a different beading roll for each gage, thus requiring the manufacturer to stock different beading rolls and to replace the beading roll of each tube each time a firetube boiler with a different gage tube is being fabricated.

The beading roll is subject to very large axial forces and very high contact stresses. The contact stresses are particularly high between the beading roll and each of the two thrust rolls, which make essentially line contact between convex surfaces of small radii. The high contact stresses result in wear and a short life for the beading roll and the thrust rolls.

SUMMARY OF THE INVENTION

One object of the present invention is to provide a tool for simultaneously expanding and beading a tube of a firetube boiler that consistently and reliably produces beads that are tangent to the expanded part of the tube within the receiving hole in the tube sheet and that are free of any ridge or protrusion at the juncture of the bead with the expanded tube portion. Another object is to enable a single bead roll to be used with tubes of different gages. It is also an object of the present invention to provide a beading and expanding tool that is durable and in which, in particular, the beading roll and the axial thrust-exerting component associated with the beading roll have long service lives. It is contemplated, moreover, that a tool, according to the present invention, will find use in expanding and forming flanges of other shapes, such as flared, tapered flanges, or right angle flanges, on a tube received in a hole in a sheet or plate.

The foregoing objects are attained, in accordance with the present invention, by a tool for expanding an end portion of a tube into engagement with a wall of a hole in a sheet or plate and simultaneously forming a flange on the end of the tube. The tool has a mandrel having a longitudinal axis, a tapered portion at a distal end, and a drive portion at a proximal end, the drive portion being adapted to accept a drive device for rotating the mandrel about the mandrel axis, and a tubular cage received over the mandrel, the cage being movable axially of and rotatable relative to the mandrel. The cage carries a plurality of expanding rolls, each of which is supported for rotation in a slot in a distal portion of the cage, is displaceable radially with respect to the mandrel axis, is in rolling engagement with the tapered portion of the mandrel, is adapted to be in rolling engagement with the tube when the tool is in operation, and is skewed at a small angle to the longitudinal axis of the mandrel so as to impart traction to the mandrel and draw it distally into the cage upon rotation of the mandrel. A forming roll is supported for rotation and for displacement radially with respect to the longitudinal axis of the mandrel in an opening in the cage and has the following surfaces:

at least one conical following surface that is in rolling engagement with the tapered portion of the mandrel;

a conical expanding surface that is adapted to be in rolling engagement with the tube when the tool is in operation;

a forming surface immediately adjacent the expanding surface proximally that is adapted to be in rolling engagement with the tube when the tool is in operation, and a conical thrust-receiving surface at a proximal end.

The thrust-receiving surface at the proximal end of the forming roll is in rolling engagement with an annular thrust bearing, which is supported on and surrounds the cage proximally of the forming roll and transmits axial thrust from the cage to the forming roll.

Significant advantages are provided by the unique forming roll. The expanding surface of the forming roll performs part of the expanding of the tube, the forming roll being pushed outwardly with the expanding rolls by the tracking of the following surface with the mandrel as the expanding and forming occurs. In preferred embodiments, at least a portion of the forming surface of the forming roll immediately adjacent the expanding surface is a surface of revolution generated by an arc that is substantially tangent to the expanding surface. That configuration ensures that the flange on the tube has a radiused juncture that is tangent to the expanded portion of the tube and that there is no ridge or protrusion at the juncture of the flange and the expanded portion of the tube. Also, the corresponding radially outward excursions of the expanding rolls and the forming roll permit the forming roll to be used with tubes of different gages.

It is highly desirable for the forming roll to include two following surfaces that track the mandrel, one adjacent the distal end of the forming roll and the other between the forming surface and the thrust-receiving surface. The two following surfaces straddle the expanding and forming surfaces and are segments of a single cone. The two following surfaces stabilize the forming roll against any possible rocking motion in the radial direction and ensure radial translation and tracking of the forming roll with respect to the mandrel and uniform pressure of the expanding surface against the tube.

The transmission of an axial force to the forming roll by an annular thrust bearing that extends circumferentially of the cage reduces stresses and increases the service life of the forming roll. The thrust bearing, which is preferably a needle bearing with two races, provides engagement between the curved surface of the forming roll and a flat surface of the distal race of the bearing. The contact stress is significantly less than the contact stress that occurs when two small radius rolls engage. The relatively large size of the thrust bearing also permits it to be very strong and long-lived, as compared with a tiny journal bearing for a thrust roll.

It is advantageous for thrust to be applied to a forming roll of a tube expanding and flange-forming tool by an annular axial thrust bearing carried by the cage of the tool in which the forming roll is mounted in any suitable manner on the cage but does not interact directly with the mandrel or include an expanding surface. Thus, although it is desirable to have a forming roll that tracks the mandrel and has an expanding surface, such a forming roll is not essential to obtaining advantages over previously known tube-expanding and flange-forming tools.

Preferably, the thrust bearing is supported on the cage in engagement with the forming roll by a thrust nut that is threaded onto the cage for adjustment axially of the cage, thus facilitating adjusting the position of the thrust bearing for optimal formation of the bead by the forming roll. The thrust nut is backed up by a stop nut that is threaded onto the cage and ensures that the thrust nut is locked in a selected position in operation of the tool.

Advantageously, a collar is received over the cage and has a distal end surface that is in rolling engagement with the thrust-receiving surface such as to retain the forming roll in the opening in the cage in which it is received when the tool is not in use and when it is being inserted into a tube in readiness for use. The collar also covers and protects the thrust bearing. The collar may be mounted on the cage so as to be displaceable away proximally of the forming roll to enable removal of the forming roll from the opening in the cage for replacement. In a preferred arrangement a spring biases the collar distally of the cage and yields to enable the collar to be displaced proximally by the forming roll as the forming roll is displaced radially outwardly when the tube is being expanded in operation of the tool. Wear of the engaging end of the collar is minimized by making the engaging distal end surface a conical surface that substantially matches the thrust-receiving surface of the forming roll.

Although more than one forming roll can be provided and as few as three expanding rolls will perform adequately, it has been found that the tool works best with five expanding rolls and one forming roll. One of the expanding rolls may be shorter than all of the other expanding rolls and received on the cage generally axially of the forming roll.

An adjusting sleeve mounted on the cage for axial adjustment and engageable by a stop shoulder on the mandrel limits movement of the mandrel relative to the cage in a direction distally of the mandrel. According to the present invention, a mandrel bearing engaged between the adjusting sleeve and the stop shoulder on the mandrel facilitates rotation of the mandrel relative to the cage after the mandrel has reached the adjusted stop position.

Another optional, but preferred and advantageous, feature of the invention is the provision of a retainer tube received within the distal end of the cage and having slots through which the expanding rolls protrude, the slots being narrower than the expanding rolls so that the expanding rolls cannot be released inwardly through the slots from support in the cage when the mandrel is removed. Similarly, the opening in the cage that receives the forming roll has at its radially inner portion tapered retaining surfaces that prevent the forming roll from leaving the opening in the radially inward direction when the mandrel is removed. When the initial clearances between the tube and the tool are small and the available working space between the tube sheet and objects facing it is small, the cage can be inserted into the tubes with the mandrel removed.

BRIEF DESCRIPTION OF THE DRAWINGS

For a better understanding of the present invention, reference may be made to the following description of an exemplary embodiment, taken in conjunction with the accompanying drawings.

DETAILED DESCRIPTION OF THE INVENTION

A preferred embodiment of the present invention and its advantages are best understood by referring to FIGS. 1–6 of the drawings, like numerals being used for like and corresponding parts of the various drawings.

The embodiment is a tool for expanding the end portions of the tubes T(see FIG. 6) of a firetube boiler into sealed and affixed engagement with the walls of holes H in a tube sheet TS and forms a bead B of arcuate cross section on a projecting end of the tube. (In FIG. 6, half of the tube is not shown.)

Figure 1:
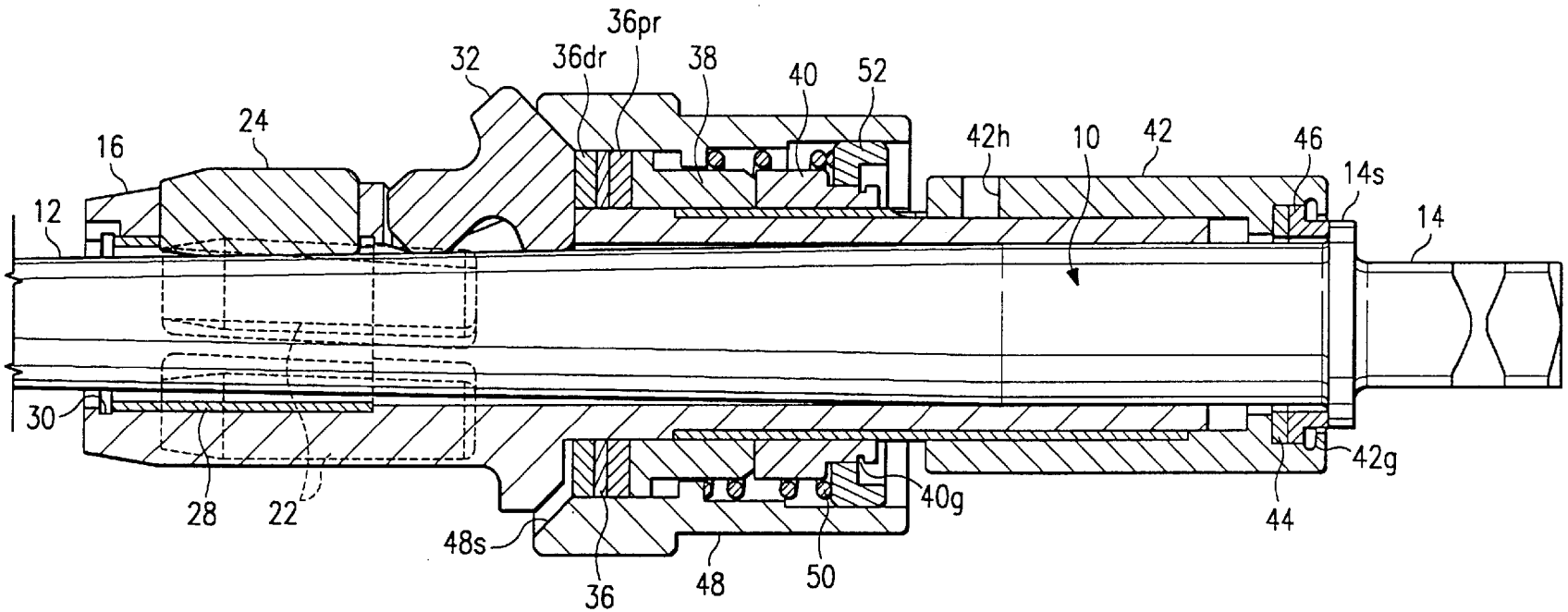
FIG. 1 is an axial side cross-sectional view of the embodiment, a part of the distal end of the mandrel being omitted.
Figure 2:
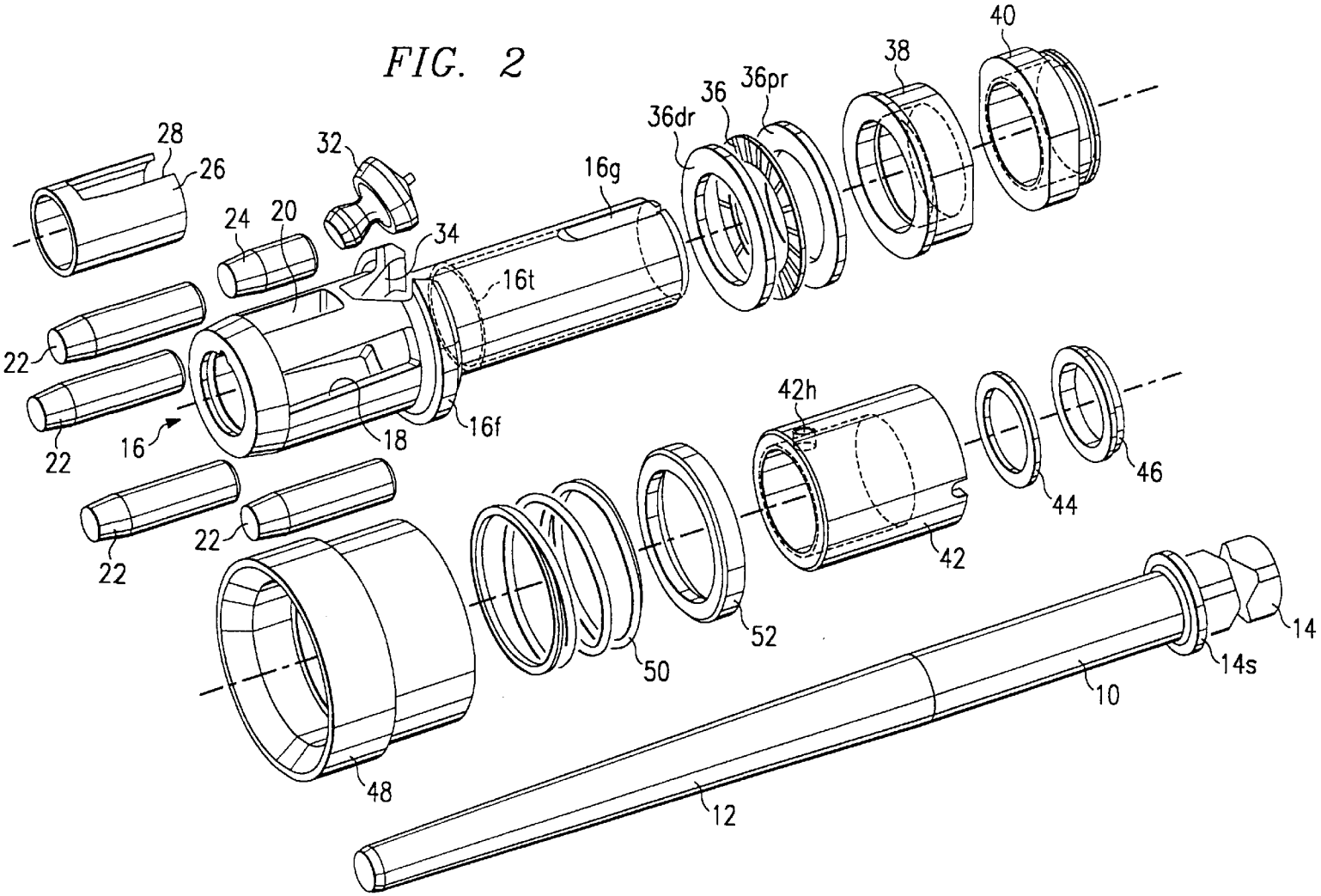
FIG. 2 is an exploded pictorial view.
Figure 3:
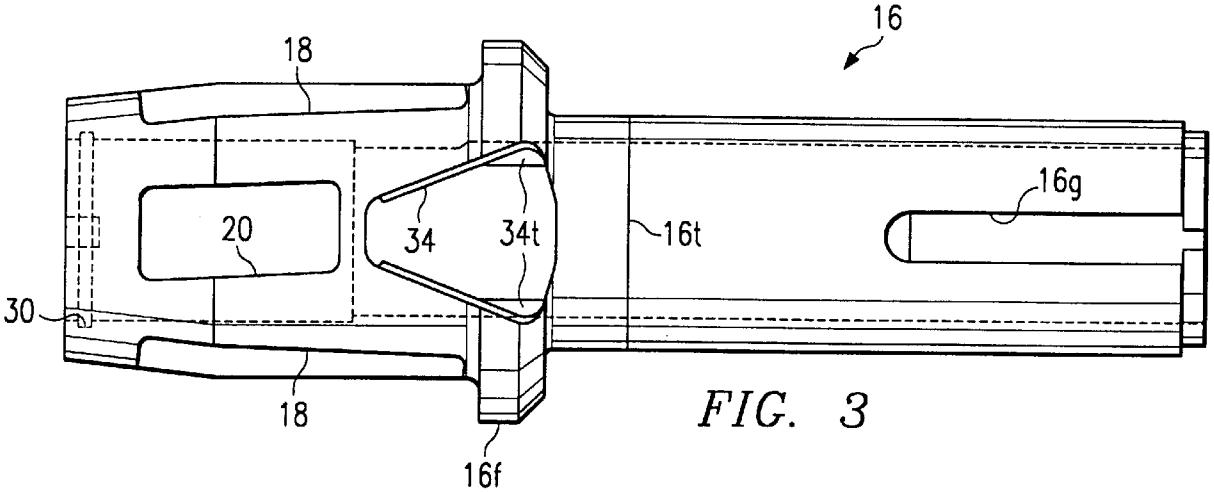
FIG. 3 is an elevational view of the side of the cage that receives the forming roll.
Figure 4:
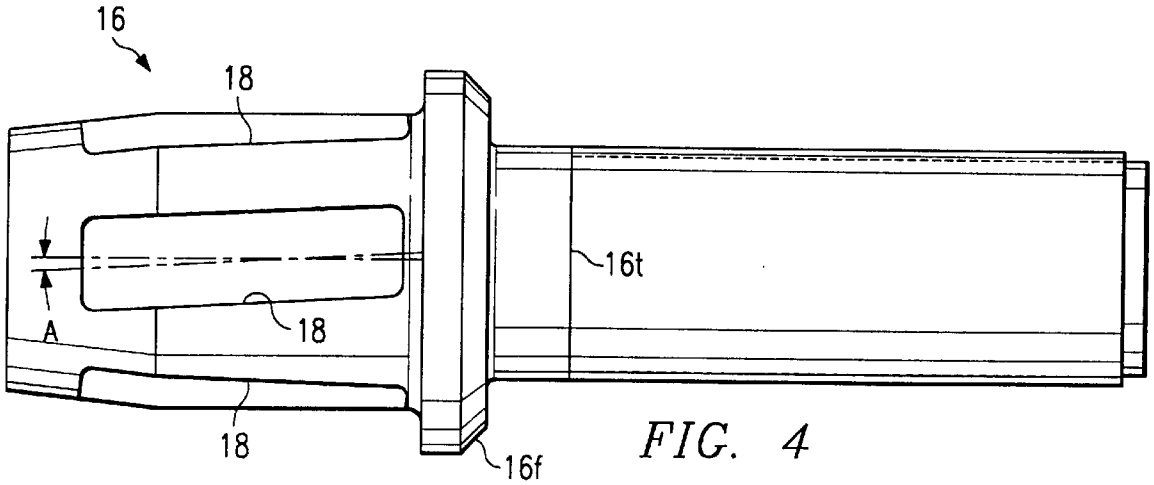
FIG. 4 is a partial elevational view of a side of the cage, viewing one of the expanding roll slots.
Figure 5:
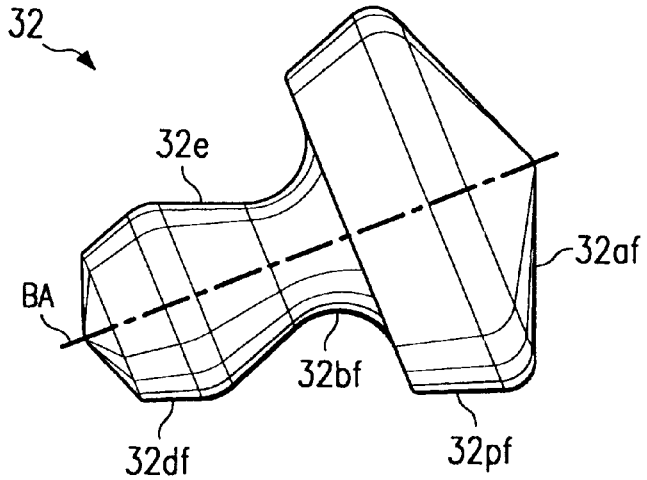
FIG. 5 is a partial axial cross-sectional view of the embodiment, showing it in place within a tube that has been expanded and beaded.

Referring to FIGS. 1 and 2, a mandrel 10 having a tapered distal end portion 12 and a drive head 14 at the proximal end is received for rotation and axial displacement within a cage 16. The distal end portion of the cage 16 has four longer slots 18 and one shorter slot 20. Each longer slot receives a longer expanding roll 22, and the shorter slot receives a shorter expanding roll 24. The expanding rolls are tapered longitudinally at a taper complementary to that of the mandrel. The five slots are equally spaced apart circumferentially and have longer side walls that are planar, diverge distally in correspondence with the taper of the expanding rolls, and are in clearance with the expanding rolls to enable radial displacement of the rolls. Each slot 18 and 20 is, more particularly, shaped throughout most of its radial and axial extent to match the profile of the expanding roll 22 or 24 that it receives. The longer, lateral wall of each slot has a lip (not shown) adjacent the outer surface of the cage that retains the expanding roll against falling out of the slot. A retainer sleeve 26 having five open-ended slots 28 (only one is shown in FIG. 2) slides into the distal end of the cage and keeps the expanding rolls from falling inwardly into the inner cavity of the cage when the mandrel is removed, each slot having a width less than the diameter of the forming rolls. The retainer sleeve is held in place by a retainer ring (not shown) that snaps into a groove 30. The roll-receiving cavities formed by the cage 24 and the sleeve 26 are configured to hold the expanding rolls in place axially, allow them to rotate about their axes, cause them to move circumferentially with the cage about the mandrel and within the tube, and allow them to displace outwardly from an innermost position in engagement with the tapered portion of the mandrel and with enough clearance to allow the tool to be inserted into a tube and an outermost position in which the thinnest gage tube for which the tool is to be used has been expanded and beaded. Each of the slots 18 and 20 is skewed at a small angle A (FIGS. 3 and 4), 2.25° being suitable, to a diametrical plane of the cage.

A forming roll 32 is received in an opening 34 in the cage 16 that is located proximally and generally axially of the smaller slot 30. In the embodiment, the forming roll 32 is configured to form a bead on the tube and is, accordingly, referred to hereinafter as a "beading roll." A flange 16*f* on the cage forms radially outer side margins of a proximal portion of the opening 34. The radially inner side margins of a portion of the opening 34 that receives the proximal portion of the beading roll 32 diverge outwardly to provide tapered surfaces 34*t* (see FIG. 3) that define an inner opening that is smaller than the larger proximal head portion of the beading roll (described below) so that the beading roll cannot fall into the cavity within the cage when the mandrel is removed. To advantage, when the tool is used to expand tubes in a confined space, the mandrel may be removed and the cage inserted into the tube. In plan, the opening is shaped to match the profile of surfaces 32*df* and 32*pf* (described below) of the beading roll such that the beading roll can translate radially but is retained against lateral skewing from a position in which its axis lies in a diametrical plane of the cage.

The beading roll 32 (see FIG. 5) has the following surfaces, all of which are segments of conical surfaces defined with respect to a beading roll axis BA:

a distal mandrel follower surface 32*df;* a proximal mandrel follower surface 32*pf;* an expanding surface 32*e*; and an axial force-receiving surface 32*af.*

Figure 6:
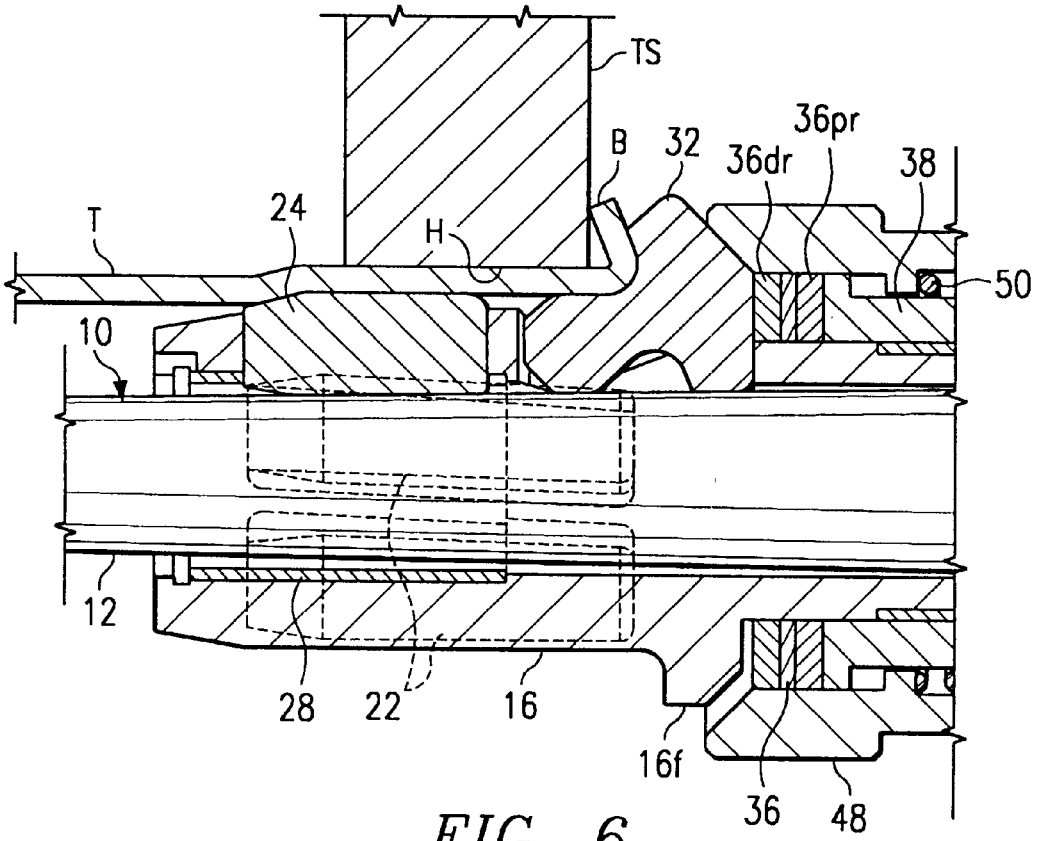
FIG. 6 is an elevational view of the forming roll of the tool.

The conical surfaces are in rolling engagements as follows:

32*df* and 32*pf*—the tapered portion 12 of the mandrel 10;

32*e*—a portion of the tube T within the receiving hole H in the tube sheet TS (see FIG. 6);

32*af*—the distal race 36*dr* of an annular two race axial thrust needle bearing 36.

A bead-forming surface 32*bf* of the beading roll engages a portion of the tube T that projects beyond the outer surface of the tube sheet TS. The bead-forming surface is a surface of revolution about the axis BA formed by an arcuate line that is tangent to the expanding surface 32*e*.

The distal portion of the cage 16 has external threads that extend proximally from the line 16*t* to the proximal end and receive, in order proximally from the line 16*t:* a thrust nut 38, which engages the proximal race 36*pr* of the thrust bearing 36 and enables the axial position of the thrust bearing and the working position of the beading roil 32 to be set as desired;

a stop nut 40, which locks the thrust nut 38 in the adjusted position; and an adjusting sleeve 42, which is described below and which can be set in increments of the thread pitch distance and is held in the adjusted position by a set screw (not shown) received in a hole 42*h* and engaged in a groove 16*g* in the cage 16. The proximal end of the adjusting sleeve 42 receives a mandrel thrust bearing 44 and a mandrel thrust plate 46, which are held in place by a retaining ring (not shown) that snaps into a groove 42*g*.

When the tool is not in use or is being inserted into a tube for operation, a collar 48 keeps the beading roll in its nested position in the receiving opening 34 of the cage. A spring 50 engaged between the collar and a spring stop ring 52, which is retained by a retainer ring (not shown) received in a groove 40*g* in the stop nut 40, biases the collar distally to engage a tapered end surface 48*s* in line contact along a diametrical line with the thrust-receiving surface 32*af* of the beading roll. The collar covers and protects the thrust bearing and can be easily pulled proximally against the spring bias to release the beading roll so that it can be removed and replaced or checked for wear or damage. The spring also yields to allow the collar to back up proximally as the beading roll translates outwardly during operation of the tool.

The tool is received in a rotary power driver, which is commercially available from INTOOL Incorporated of Springfield, Ohio, and has a chuck that engages the drive portion 14 of the mandrel. The tool operator inserts the tool into the tube T far enough to engage the bead-forming surface of the beading roll with the end of the tube and with enough distal axial pressure to tighten tre tapered part of the mandrel within the expanding rollers and engage them firmly with the inner wall of the tube T. The driver is turned on and drives the mandrel in rotation. The expanding rolls, because of their skew to the longitudinal axis, produce a drafting action on the mandrel, which is drawn distally farther into the cage. The cage and expanding rolls rotate with the mandrel, but at a slower rotational speed, the expanding rolls rotating about their axes in reverse hand, relative to the rotation of the mandrel, and causing them to rotate and orbit like planet gears and a planet carrier around a sun gear.

The expanding rolls progressively translate outwardly as the tapered part of the mandrel is pulled farther into the cage and gradually expand the tube T into firm engagement with the receiving hole in the tube sheet TS. Eventually, the mandrel is pulled into the cage far enough to bring a shoulder 14*s* into engagement with the mandrel thrust plate, which stops the mandrel from being drawn any farther into the cage and stops the tool from further expanding the tube.

Meanwhile, the follower surfaces 34*df* and 34 *bf* of the beading roll are following the mandrel, so the beading roll is also being translated radially outwardly in tandem with the expanding rolls. The expanding surface 32*e* of the beading roll works with the expanding rolls in expanding the tube and, in particular, work against the tube at the juncture between the expanded part within the hole in the tube sheet and the bead. Also, of course, the bead-forming surface 32*bf* is forming the bead by progressively rolling the projecting end of the tube out as the cage is drawn into the mandrel by the drafting action of the expanding rolls.

The beading roll is subject to very nigh axial loads, which are exerted on it by the thrust bearing 36, the distal race 36*dr* of which is in rolling (line) contact with the thrust-receiving surface 32*af* of the beading roll and rotates relative to the proximal race and the cage as the beading roll rotates. The thrust bearing is of large size and thus is very strong and long-lived.

As mentioned above, the tool of the present invention can be used not only to form beads but other flange shapes, such as tapers (flared ends) or flat flanges, each with a radiused juncture with an adjacent expanded portion of the tube. The only modification needed for such uses is to change the shape of the forming surface 32*bf*. Also, the tool can be modified to support a forming roll on the cage independently of the mandrel but still transferring axial thrust to it by an axial thrust bearing that surrounds the cage.

Although the present invention and its advantages have been described in detail, it should be understood that various changes, substitutions, and alterations can be made therein without departing from the spirit and scope of the invention as defined by the appended claims.

What is claimed is:

1. A tool for expanding an end portion of a tube into engagement with a wall of a hole in a plate and forming a flange on the end of the tube comprising:

a mandrel having a longitudinal axis, a tapered portion at a distal end, and a drive portion at a proximal end, the drive portion being adapted to accept a drive device for rotating the mandrel about the mandrel axis;

a tubular cage received over the mandrel, the cage being movable axially of and rotatable relative to the mandrel;

a plurality of expanding rolls, each of which is supported for rotation in a slot in a distal portion of the cage, is displaceably radially with respect to the mandrel axis, is in rolling engagement with the tapered portion of the mandrel, is adapted to be in rolling engagement with the tube when the tool is in operation, and is skewed at a small angle to the mandrel axis so as to impart traction to the cage and the mandrel and draw them distally into the cage upon rotation of the mandrel;

a forming roll supported for rotation and for displacement radially with respect to the mandrel axis in an opening in the cage, the forming roll having:

at least one conical following surface that is in rolling engagement with the tapered portion of the mandrel, a conical expanding surface that is adapted to be in rolling engagement with the tube when the tool is in operation, a forming surface immediately adjacent the expanding surface proximally that is adapted to be in rolling engagement with the tube when the tool is in operation, and a conical thrust-receiving surface at a proximal end; and an annular axial thrust bearing supported on and surrounding the cage proximally of the forming roll, wherein the forces exerted on said forming roll by said tube tend to increase the compressive force on said thrust bearing.

2. A tool according to claim 1 wherein the forming surface of the forming roll includes a portion immediately adjacent the expanding surface that is a surface of revolution generated by an arc that is substantially tangent to the expanding surface.

3. A tool according to claim 2 wherein the forming surface of the forming roll is a surface of revolution generated by a substantially arcuate line that is substantially tangent to the expanding surface so as to form a bead on the end of the tube that is substantially arcuate in cross section, is tangent to an adjacent expanded portion of the tube, and has a convex surface facing away from the plate.

4. A tool according to claim 1 wherein the forming roll includes a first following surface distally of the expanding surface and a second following surface intermediate the forming surface and the thrust-receiving surface, the first and second following surfaces being segments of a single cone.

5. A tool according Lo claim 1 and further comprising a collar received over the cage and having a distal end surface that is in rolling engagement with the thrust-receiving surface such as to retain the forming roll in the opening in the cage in which it is received.

6. A tool according to claim 5 wherein the collar is displaceable away proximally of the forming roll to enable removal of the forming roll from the opening in the cage for replacement.

7. A tool according to claim 5 and further comprising a spring biasing the collar distally of the cage, the spring being yieldable to enable the collar to be displaced proximally by the forming roll as the forming roll is displaced radially outwardly when the tube is being expanded in operation of the tool.

8. A tool according to claim 5 wherein the collar has a distal conical surface that substantially matches the thrust-receiving surface of the forming roll.

9. A tool according to claim 1 wherein the thrust bearing is a needle bearing with two races.

10. A tool according to claim 1 wherein the axial thrust bearing is supported on the cage in engagement with the forming roll by a thrust nut that is threaded onto the cage for adjustment axially of the cage.

11. A tool according to claim 10 wherein the thrust nut is backed up by a stop nut that is threaded onto the cage and ensures that the thrust nut is locked in a selected position in operation of the tool.

12. A tool according to claim 1 wherein one of the expanding rolls is shorter than all of the other expanding rolls and the shorter expanding roll is received on the cage generally axially of the forming roll.

13. A tool according to claim 1 and further comprising an adjusting sleeve mounted on the cage for axial adjustment and engageable by a stop shoulder on the mandrel such as to limit movement of the mandrel relative to the cage in a direction distally of the mandrel.

14. A tool according to claim 13 and further comprising a mandrel bearing engageable between the adjusting sleeve and the stop shoulder on the mandrel.

15. A tool according to claim 1 and further comprising a retainer tube received within the cage and having slots through which portions of the expanding rolls protrude, the slots being narrower than the expanding rolls so that the expanding rolls cannot be released inwardly through the slots from support in the cage when the mandrel is removed.

16. A tool according to claim 1 wherein the opening in the cage that receives the forming roll has at its radially inner portion tapered retaining surfaces that prevent the forming roll from leaving the opening in the radially inward direction when the mandrel is removed from the cage.

17. The tool of claim 1 wherein the forces exerted on said forming roll by said tube tend to compress said axial thrust bearing via said forming roll and one or fewer intervening members.

18. The tool of claim 1 wherein the forces exerted on said axial thrust bearing is disposed in direct rolling engagement with said thrust receiving surface of said forming roll.

19. The tool of claim 1 wherein said forming roll has a longitudinal axis of symmetry intersecting said thrust receiving surface and wherein, during operation, said forming roll connects to said thrust bearing only at locations disposed with respect to said mandrel axis not more radially outward than said intersection of said forming roll axis with said thrust receiving surface.

20. The tool of claim 1 wherein, during forming, said forming roll rotates in a first direction and transmits the forces exerted on said forming roll by said tube to said thrust bearing through direct contact with a member, distinct from said cage, that rotates about said mandrel axis.

21. A tool for expanding an end portion of a tube into engagement with a wall of a hole in a tube sheet and forming a bead on the end of the tube comprising:

a mandrel having a longitudinal axis, a tapered portion at a distal end, and a drive portion at a proximal end, the drive portion being adapted to accept a drive device for rotating the mandrel about the mandrel axis;

a tubular cage received over the mandrel, the cage being movable axially of and rotatable relative to the mandrel;

a plurality of expanding rolls, each of which is supported for rotation in a slot in a distal portion of the cage, is displaceable radially with respect to the mandrel axis, is in rolling engagement with the tapered portion of the mandrel, is adapted to be in rolling engagement with the tube when the tool is in operation, and is skewed at a small angle to the mandrel axis so as to impart traction to the mandrel and draw it distally into the cage upon rotation of the mandrel;

a forming roll supported for rotation and for displacement radially with respect to the mandrel axis in an opening in the cage, the forming roll having:

a first conical following surface adjacent a distal end, the first conical following surface being in rolling engagement with the tapered portion of the mandrel, a conical expanding surface that is adapted to be in rolling engagement with the tube when the tool is in operation, a forming surface immediately adjacent the expanding surface that is adapted to be in rolling engagement with the tube when the tool is in operation and includes a portion immediately adjacent the expanding surface that is a surface of revolution generated by an arc that is substantially tangent to the expanding surface, a second conical following surface proximally of the forming surface, the second conical following surface being in rolling engagement with the tapered portion of the mandrel and the first and second following surfaces being segments of a single cone, and a conical thrust-receiving surface at a proximal end, and an annular axial thrust bearing supported on and surrounding the cage proximally of the forming roll, wherein the forces exerted on said forming roll by said tube tend to increase the compressive force on said thrust bearing.

22. A tool according to claim 21 wherein the forming surface of the forming roll is a surface of revolution generated by a substantially arcuate line so as to form a bead on the end of the tube that is substantially arcuate in cross-section and has a convex surface facing away from the tube sheet.

23. A tool according to claim 21 and further comprising a collar received over the cage and having a distal end surface that is in rolling engagement with the thrust-receiving surface such as to retain the forming roll in the opening in the cage in which it is received.

24. A tool according to claim 23 wherein the collar is displaceable away proximally of the forming roll to enable removal of the forming roll from the opening in the cage for replacement.

25. A tool according to claim 24 and further comprising a spring biasing the collar distally of the cage, the spring being yieldable to enable the collar to be displaced proximally by the forming roll as the forming roll is displaced radially outwardly when the tube is being expanded in operation of the tool.

26. A tool according to claim 25 wherein the collar has a distal conical surface that substantially matches the thrust-receiving surface of the forming roll.

27. A tool according to claim 21 wherein the axial thrust bearing is a needle bearing with two races.

28. A tool according to claim 21 wherein the axial thrust bearing is supported on the cage in engagement with the forming roll by a thrust nut that is threaded onto the cage for adjustment axially of the cage.

29. A tool according to claim 28 wherein the thrust nut is backed up by a stop nut that is threaded onto the cage and ensures that the thrust nut is locked in a selected position in operation of the tool.

30. A tool according to claim 21 wherein one of the plurality of expanding rolls is shorter than the other of the plurality of expanding rolls and the shorter expanding roll is received on the cage generally axially of the forming roll.

31. A tool according to claim 21 and further comprising an adjusting sleeve mounted on the cage for axial adjustment and engageable by a stop shoulder on the mandrel such as to limit movement of the mandrel relative to the cage in a direction distally of the mandrel.

32. A tool according to claim 31 and further comprising a mandrel bearing engageable between the adjusting sleeve and the stop shoulder on the mandrel.

33. A tool according to claim 21 and further comprising a retainer tube received within the cage and having slots through which portions of the expanding rolls protrude, the slots being narrower than the expanding rolls so that the expanding rolls cannot be released inwardly through the slots from support in the cage when the mandrel is removed.

34. A tool according to claim 21 wherein the opening in the cage that receives the forming roll has at its radially inner portion tapered retaining surfaces that prevent the forming roll from leaving the opening in the radially inward direction when the mandrel is removed from the cage.

35. The tool of claim 21 wherein the forces exerted on said forming roll by said tube tend to compress said axial thrust bearing via said forming roll and one or fewer intervening members.

36. The tool of claim 21 wherein the forces exerted on said axial thrust bearing is disposed in direct rolling engagement with said thrust receiving surface of said forming roll.

37. A tool for expanding an end portion of a tube into engagement with a wall of a hole in a plate and forming a flange on the end of the tube comprising:

a mandrel having a longitudinal axis, a tapered portion at a distal end, and a drive portion at a proximal end, the drive portion being adapted to accept a drive device for rotating the mandrel about the mandrel axis;

a tubular cage received over the mandrel, the cage being movable axially of and rotatable relative to the cage;

a plurality of expanding rolls, each of which is supported for rotation in a slot in a distal portion of the cage, is displaceable radially with respect to the mandrel axis, is in rolling engagement with the tapered portion of the mandrel, is adapted to be in rolling engagement with the tube when the tool is in operation, and is skewed at a small angle to the mandrel axis so as to impart traction to the mandrel and draw it distally into the cage upon rotation of the mandrel;

a forming roll supported for rotation on the cage and having a forming surface, the forming surface being adapted to be in rolling engagement with the end of the tube when the tool is in operation and being shaped to form a flange on the end of the tube, and a conical thrust-receiving surface at a proximal end; and an annular axial thrust bearing supported on and surrounding the cage proximally of the forming roll, wherein the forces exerted on said forming roll by said tube tend to increase the compressive force on said thrust bearing.

38. A tool according to claim 37 wherein the axial thrust bearing is a needle bearing with two races.

39. A tool according to claim 37 wherein the axial thrust bearing is supported on the cage in engagement with the forming roll by a thrust nut that is threaded onto the cage for adjustment axially of the cage.

40. A tool according to claim 39 wherein the thrust nut is backed up by a stop nut that is threaded onto the cage and ensures that the thrust nut is locked in a selected position in operation of the tool.

41. A tool according to claim 37 and further comprising an adjusting sleeve mounted on the cage for axial adjustment and engageable by a stop shoulder on the mandrel such as to limit movement of the mandrel relative to the cage in a direction distally of the mandrel.

42. A tool according to claim 41 and further comprising a mandrel bearing engageable between the adjusting sleeve and the stop shoulder on the mandrel.

43. A tool according to claim 37 and further comprising a retainer tube received within the cage and having slots through which the expanding rolls protrude, the slots being narrower than the expanding rolls so that the expanding rolls cannot be released inwardly through the slots from support in the cage when the mandrel is removed.

44. A tool according to claim 37 wherein the opening in the cage that receives the forming roll has at its radially inner portion tapered retaining surfaces that prevent the forming roll from leaving the opening in the radially inward direction when the mandrel is removed from the cage.

45. The tool of claim 37 wherein the forces exerted on said forming roll by said tube tend to compress said axial thrust bearing via said forming roll and one or fewer intervening members.

46. The tool of claim 37 wherein the forces exerted on said axial thrust bearing is disposed in direct rolling engagement with said thrust receiving surface of said forming roll.

* * * * *